US008353340B2

(12) United States Patent
Sarathi et al.

(10) Patent No.: US 8,353,340 B2
(45) Date of Patent: Jan. 15, 2013

(54) IN SITU COMBUSTION WITH MULTIPLE STAGED PRODUCERS

(75) Inventors: Partha S. Sarathi, Bartlesville, OK (US); Wayne Reid Dreher, Jr., Katy, TX (US); Riley Bryan Needham, Bartlesville, OK (US); Abhishek Dutta, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 343 days.

(21) Appl. No.: 12/838,069

(22) Filed: Jul. 16, 2010

(65) Prior Publication Data

US 2011/0011582 A1 Jan. 20, 2011

Related U.S. Application Data

(60) Provisional application No. 61/226,534, filed on Jul. 17, 2009.

(51) Int. Cl.
*E21B 43/243* (2006.01)
*E21B 43/30* (2006.01)

(52) U.S. Cl. ..... 166/256; 166/272.7; 166/245; 166/52

(58) Field of Classification Search ..... 166/256, 166/268, 272.1, 272.3, 272.7
See application file for complete search history.

(56) References Cited

U.S. PATENT DOCUMENTS

| | | | |
|---|---|---|---|
| 3,680,634 | A | 8/1972 | Peacock et al. |
| 4,323,120 | A | 4/1982 | Ginsburgh et al. |
| 4,415,031 | A | 11/1983 | Hunt, III |
| 4,495,994 | A | 1/1985 | Brown et al. |
| 4,552,216 | A | 11/1985 | Wilson |
| 4,557,329 | A | 12/1985 | Savard et al. |
| 4,729,431 | A | 3/1988 | Bousaid |
| 4,961,467 | A | 10/1990 | Pebdani |
| 5,027,896 | A | 7/1991 | Anderson |
| 5,211,230 | A | 5/1993 | Ostapovich et al. |
| 5,339,897 | A | 8/1994 | Leaute |
| 5,443,118 | A | 8/1995 | Yannimaras et al. |
| 5,449,038 | A | 9/1995 | Horton et al. |

(Continued)

FOREIGN PATENT DOCUMENTS

CN 101161988 9/2007

(Continued)

OTHER PUBLICATIONS

Akin, et al. "Oxidation of Heavy Oil and Their SARA Fractions: Its Role In Modeling In-Situ Combustion", SPE 63230, 2000 SPE Annual Technical Conference and Exhibition held in Dallas, Texas, Oct. 1-4, 2000.

(Continued)

*Primary Examiner* — Angela M DiTrani
(74) *Attorney, Agent, or Firm* — ConocoPhillips Company

(57) ABSTRACT

Methods and apparatus relate to in situ combustion. Configurations of the injection and production wells facilitate the in situ combustion. Utilizing wet combustion for some embodiments promotes heat displacement for hydrocarbon recovery with procedures in which one or more of the production and injection wells are configured with lengths deviated from vertical. In some embodiments for either dry or wet combustion, at least the production wells define intake lengths deviated from vertical and that are disposed at staged levels within a formation. Each of the productions wells during the in situ combustion allow for recovery of hydrocarbons through gravity drainage. Vertical separation between the intake lengths of the production wells enables differentiated and efficient removal of combustion gasses and the hydrocarbons.

17 Claims, 4 Drawing Sheets

U.S. PATENT DOCUMENTS

| | | | | |
|---|---|---|---|---|
| 5,456,315 | A * | 10/1995 | Kisman et al. | 166/245 |
| 5,458,193 | A | 10/1995 | Horton et al. | |
| 6,412,557 | B1 | 7/2002 | Ayasse et al. | |
| 7,063,145 | B2 | 6/2006 | Veenstra et al. | |
| 7,416,022 | B2 | 8/2008 | Maguire | |
| 2002/0148608 | A1 | 10/2002 | Shaw | |
| 2003/0102124 | A1 | 6/2003 | Vinegar et al. | |
| 2003/0111223 | A1 | 6/2003 | Rouffignac et al. | |
| 2003/0173082 | A1 | 9/2003 | Vinegar et al. | |
| 2005/0082057 | A1 | 4/2005 | Newton | |
| 2007/0199704 | A1 | 8/2007 | Hocking | |
| 2008/0093071 | A1 | 4/2008 | Weiers et al. | |
| 2008/0169096 | A1 | 7/2008 | Ayasse | |
| 2008/0264635 | A1 | 10/2008 | Chhina et al. | |
| 2010/0012331 | A1 * | 1/2010 | Larter et al. | 166/401 |
| 2010/0155060 | A1 * | 6/2010 | Hanna | 166/256 |
| 2010/0163229 | A1 * | 7/2010 | Nenniger | 166/272.3 |

FOREIGN PATENT DOCUMENTS

| | | |
|---|---|---|
| WO | WO02086283 | 10/2002 |
| WO | WO2007117865 | 10/2007 |

OTHER PUBLICATIONS

X. Yang, et al. "Design and Optimization of Hybrid Ex Situ / In Situ Steam Generation Recovery Processes for Heavy Oil and Bitumen" SPE 117643-MS, Int'l Thermal Operations and Heavy Oil Symp., Calgary, Alberta, Canada (Oct. 20-23, 2008).

* cited by examiner

IN SITU COMBUSTION WITH MULTIPLE STAGED PRODUCERS

CROSS-REFERENCE TO RELATED APPLICATIONS

None

STATEMENT REGARDING FEDERALLY SPONSORED RESEARCH OR DEVELOPMENT

None

FIELD OF THE INVENTION

Embodiments of the invention relate to methods and systems for oil recovery with in situ combustion.

BACKGROUND OF THE INVENTION

In situ combustion offers one approach for recovering oil from reservoirs in certain geologic formations. With in situ combustion, an oxidant injected through an injection well into the reservoir reacts with some of the oil to propagate a combustion front through the reservoir. This process heats the oil ahead of the combustion front. Further, the injection gas and combustion gasses drive the oil that is heated toward an adjacent production well.

Success of the in situ combustion depends on stability of the combustion front and ability to ensure that oxidation occurring is an exothermic reaction. Amount of beneficial thermal cracking of the oil to make the oil lighter tends to increase with higher temperatures from the oxidation. Further, oxidation of the oil by an endothermic reaction can create hydrogen bonding and result in undesired increases in viscosity of the oil.

Various factors attributed to failure of the in situ combustion include loss of ignition, lack of control, and inadequate reservoir characterization. For maximum recovery of the oil, the combustion front must be able to stay ignited in order to sweep across the entire reservoir above a horizontal portion of the production well. Due to such issues, prior approaches often result in inability to achieve recovery rates and cumulative recoveries as high as desired.

Therefore, a need exists for improved methods and systems for oil recovery with in situ combustion.

SUMMARY OF THE INVENTION

In one embodiment, a method of producing hydrocarbons utilizing in situ combustion includes forming an injection well into a formation and forming first and second production wells with respective first and second sections of the first and second production wells extending in length deviated from vertical. The method includes injecting oxidant into the injection well to propagate combustion. Further, the method includes recovering hydrocarbons through the first production well during the combustion and recovering through the first production well gasses from the combustion once liquids segregate by gravity to provide an interface between the liquids and the gasses below the first section of the first production well such that the gasses are produced through the first production well while hydrocarbons are recovered through the second production well with the second section disposed lower in the formation relative to the first section of the first production well.

According to one embodiment, a method includes injecting oxidant into an injection well to propagate combustion through a formation. Recovering hydrocarbons through a first production well occurs during the combustion while gravity segregation creates an interface between liquids and gasses in the formation that is above where the first production well intakes fluids. In addition, recovering hydrocarbons through a second production well occurs during the combustion while the gravity segregation creates the interface between the liquids and gasses in the formation that is below where the first production well intakes fluids and above where the second production well intakes fluids.

For one embodiment, a method includes injecting oxidant into an injection well to propagate combustion through a formation and recovering, during the combustion, hydrocarbons from the formation gathered in a first section of a first production well in fluid communication with the injection well. The method also includes producing with the first production well gasses generated by the combustion and that enter the first section of the first production well and recovering, during the combustion and the producing of the gasses, hydrocarbons from the formation gathered in a second section of a second production well in fluid communication with the injection well. The first and second sections extend in length deviated from vertical with the second section located lower in the formation relative to the first section of the first production well.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to in situ combustion. Configurations of the injection and production wells facilitate the in situ combustion. Utilizing wet combustion for some embodiments promotes heat displacement for hydrocarbon recovery with procedures in which one or more of the production and injection wells are configured with lengths deviated from vertical. In some embodiments for either dry or wet combustion, at least the production wells define intake lengths deviated from vertical and that are disposed at staged levels within a formation. Each of the production wells during the in situ combustion allow for recovery of hydrocarbons through gravity drainage. Vertical separation between the intake lengths of the production wells enables efficient and differentiated removal of combustion gasses and the hydrocarbons.

Figure 1:
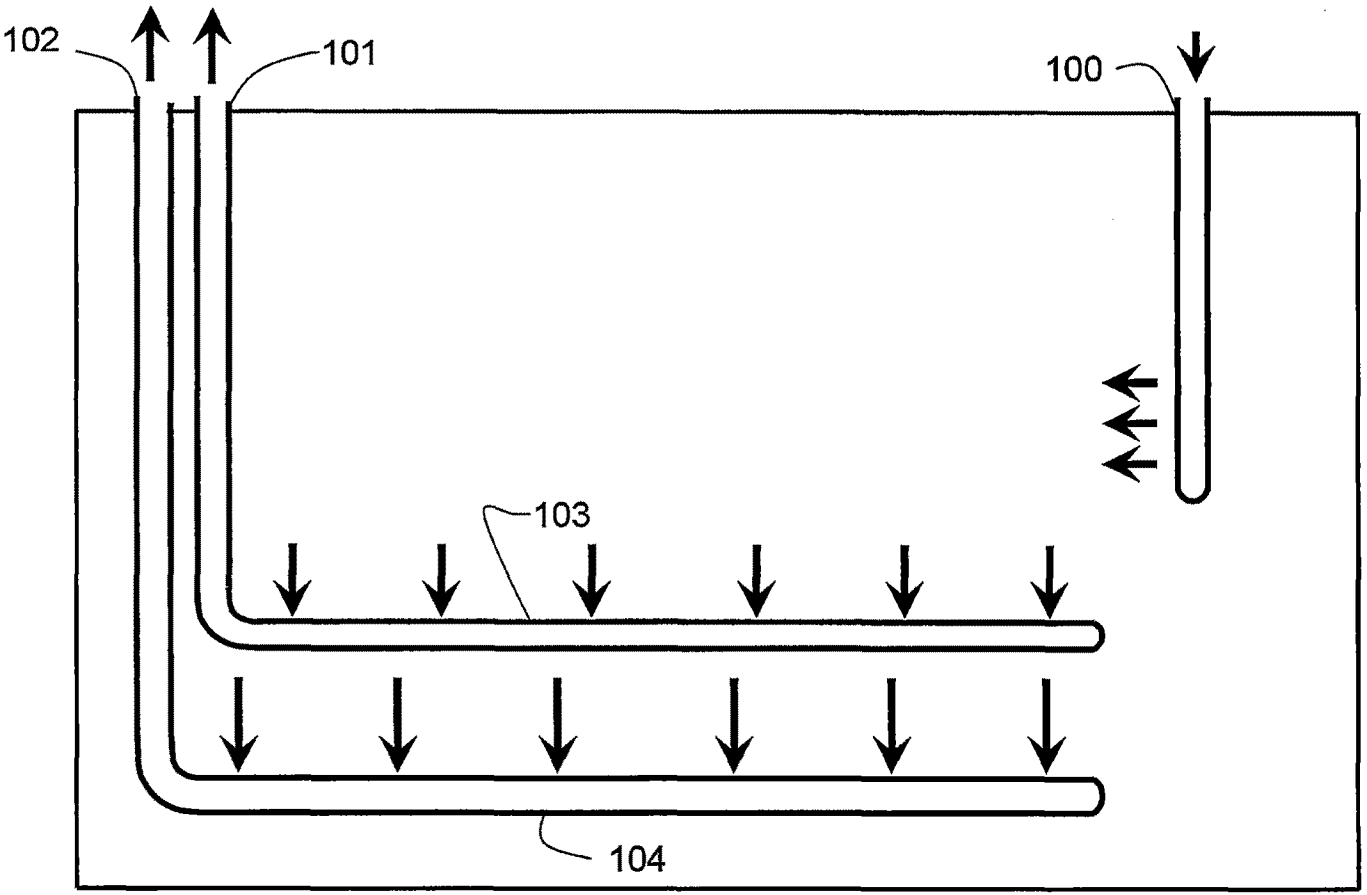
FIG. 1 is a schematic sectional side view of an injection well and staged production wells, according to one embodiment of the invention.

FIG. 1 illustrates an injection well 100, a first production well 101 and a second production well 102 disposed in a formation. The first and second production wells 101, 102 include respective first and second intake sections 103, 104 deviated from vertical. Angle of deviation from vertical for the intake sections 103, 104 may be between 20° and 160°, between 80° and 100°, or about 90°. The angle of deviation from vertical defines slant toward horizontal corresponding to 90°. As explained further herein, the first intake section 103 of the first production well 101 traverses through the formation higher relative to the second intake section 104 of the second production well 102.

The production wells 101, 102 define heels at where the production wells 101, 102 turn toward horizontal and toes at where the intake sections 103, 104 terminate distal to the heels. In some embodiments, the injection well 100 is closer to at least one of the toes of the production wells 101, 102 than a corresponding one of the heels of the production wells 101, 102. For some embodiments, at least 5 meters (m), at least 10 meters, or between 10 m and 15 m separates the first intake section 103 from the second intake section 104 that are offset from one another in a vertical direction and that may be parallel to one another.

Arrows indicate flow directions as established by fluid communication between the injection well 100 and the production wells 101, 102 throughout conducting of the in situ combustion. In operation, oxidant injected into the formation through the injection well 100 propagates a combustion front from the toes of the production wells 101, 102 to the heels of the production well 101, 102. Examples of the oxidant include oxygen or oxygen-containing gas mixtures. As the combustion front progresses through the formation, hydrocarbons warmed by the in situ combustion at least during an initial stage of the in situ combustion drain downward by gravity into the first intake section 103 and are recovered via the first production well 101.

Combustion gasses (e.g., $CO_2$ and CO) help to displace the hydrocarbons toward the first intake section 103 and also pass into the first intake section 103 of the first production well 101 for removal to prevent choking of the in situ combustion. The gasses which are more mobile than liquids can migrate through the formation to the first intake section 103. As a result of this difference in mobility, the gasses can inhibit hydrocarbon recovery when producing both the hydrocarbons that are liquids and the gasses from a common well.

The hydrocarbons warmed by the in situ combustion also drain downward by gravity into the second intake section 104 and are recovered via the second production well 102. As the in situ combustion progresses, liquids segregate by gravity to provide an interface between the liquids and the gasses below the first intake section 103 of the first production well 101 such that the gasses are produced through the first production well 101 while the hydrocarbons are recovered through the second production well 102 with the second intake section 104 disposed lower in the formation relative to the first intake section 103 of the first production well 101. Since water is injected with the oxidant in some embodiments, the liquids recovered with the second production well 102 may include water along with the hydrocarbons. Recovery of the hydrocarbons via the first production well 101 hence diminishes as the in situ combustion continues over time with the hydrocarbons continuing to be recovered via the second production well 102. For example, the gasses may form at least 75% or at least 90% of the production through the first production well 101 during a time period of the combustion in which the hydrocarbons may form at least 75% or at least 90% of the recovery through the second production well 102.

The first production well 101 with the first intake section 103 enables controlling movement of the combustion gasses by producing the combustion gasses prior to the combustion gasses reaching the second intake section 104. Production of the combustion gasses with the first intake section 103 thereby limits gas saturation around the second intake section 104. Reductions in levels of the gas saturation in vicinity of the second intake section 104 decrease impediments to free flow of the hydrocarbons. Hydrocarbon production rate and recovery depends on relative permeability to the hydrocarbons, which is thus based on the gas saturation.

The first intake section 103 of the first production well 101 increases venting potential area relative to utilizing only vertical wells where lateral area for removing the combustion gasses is limited. The first intake section 103 thereby provides areal coverage both for prevention of choking the in situ combustion and for at least initial recovery during gravity drainage. Pressure support aids downward migration of the hydrocarbons even though the gravity drainage does not require pressure gradient driving as with some recovery techniques. As a result of the areal coverage, utilizing the first intake section 103 promotes desired sweeping of the formation with the combustion front.

Figure 2:
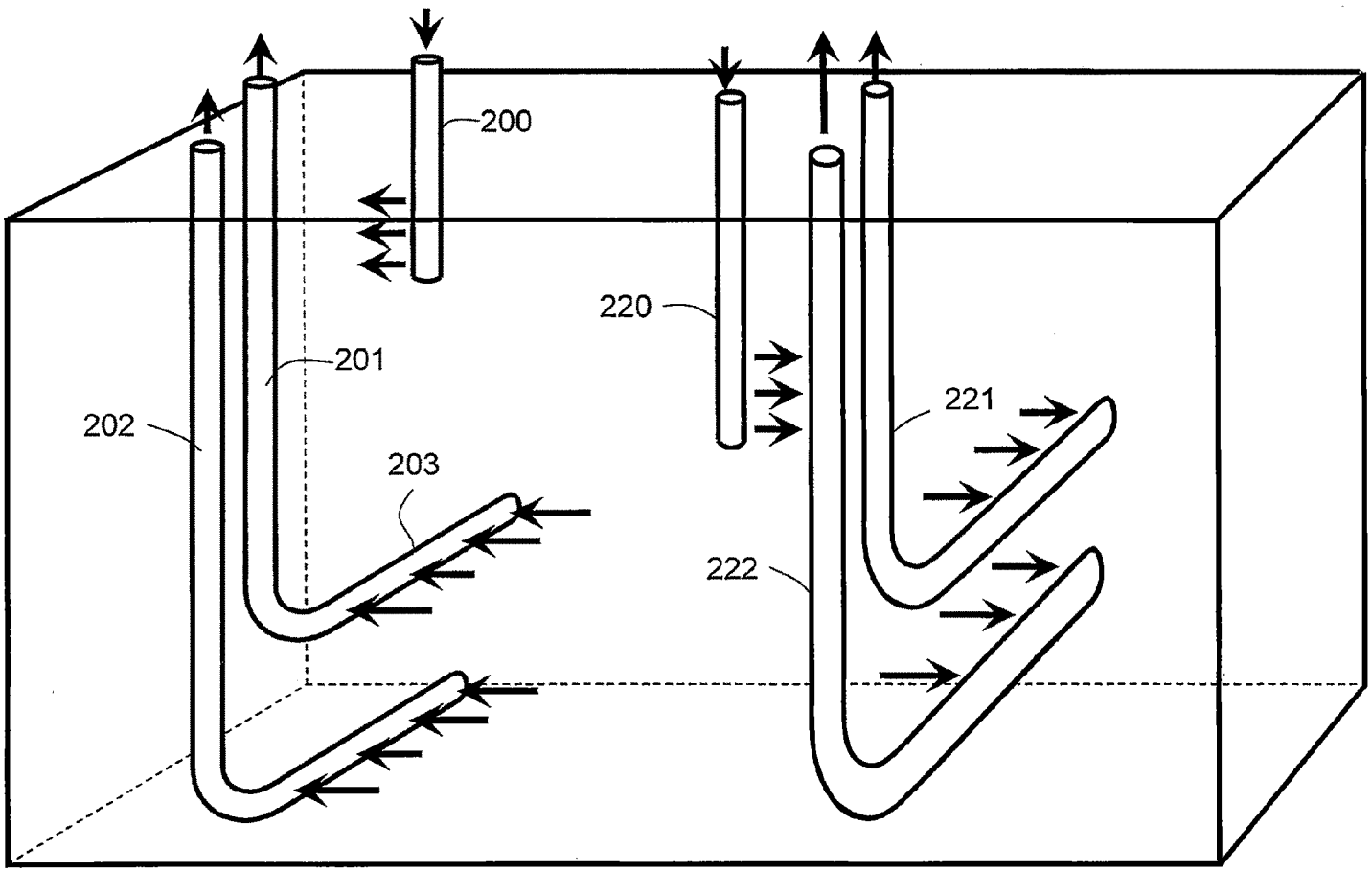
FIG. 2 is a three dimensional schematic of an exemplary arrangement of coordinated injection and production wells in a formation, according to one embodiment of the invention.

FIG. 2 shows for one embodiment an arrangement in a formation with first and second injection wells 200, 220 and first, second, third and fourth production wells 201, 202, 221, 222. The first and second injection wells 200, 220 are disposed between the first and second production wells 201, 202 and the third and fourth production wells 221, 222. Part of each of the production wells 201, 202, 221, 222 is deviated from vertical, such as intake section 203 of the first production well 201, along where inflow of fluids is permitted. The production wells 201, 202, 221, 222 may all extend parallel to one another with the first and second production wells 201, 202 disposed on a first side of the injection wells 200, 220 and the third and fourth production wells 221, 222 disposed on a second side of the injection wells 200, 220 opposite the first side. The first and third production wells 201, 221 are each open to fluid communication with the formation higher compared to a respective one of the second and fourth production wells 202, 222.

The injection wells 200, 220 terminate at different vertical levels within the formation such that oxidant is introduced above the production wells 201, 202, 221, 222 at two locations spaced in both horizontal and vertical directions from one another. The injection wells 200, 220 extend into the formation to pass closest to the production wells 201, 202, 221, 222 at intermediate points along each of the production wells 201, 202, 221, 222. Location of the injection wells 200, 220 helps ensure desired areal and vertical coverage of the in situ combustion regardless of reservoir heterogeneity and promotes lateral movement of combustion gasses and heated hydrocarbons toward the production wells 201, 202, 221, 222.

In operation, the production wells 201, 202, 221, 222 enable differentiated removal of the combustion gasses and the hydrocarbons in a manner similar to aforementioned functional aspects regarding FIG. 1. All of the production wells 201, 202, 221, 222 produce liquids including hydrocarbons heated during the in situ combustion. At any time during the in situ combustion, the production wells 201, 202, 221, 222 may produce a combination of liquids and gasses and still provide differentiation based on relative percentages of the liquids and gasses being produced. After an initial time period of the in situ combustion, the first and third production wells 201, 221 produce less of the liquids and more of the gasses than are being produced by the second and fourth production wells 202, 222 located proximate a reservoir base in the formation. A majority of the liquids produced with the first and third production wells 201, 221 occurs during the initial time period of the in situ combustion since thereafter gravity segregation of the gasses and the liquids makes the gasses closer to earth surface than the liquids and hence in vicinity of the first and third production wells 201, 221 where produced prior to reaching the second and fourth production wells 202, 222.

Temperatures in the formation from the in situ combustion may exceed acceptable levels around the production wells 201, 202, 221, 222 without management to keep the temperature from compromising the production wells 201, 202, 221, 222. Controlling production of the gasses from the second and fourth production wells 202, 222 prevents combustion temperatures from reaching the second and fourth production wells 202, 222. In some embodiments, circulating water through a casing-tubular annulus of the first and third production wells 201, 221 cools the first and third production wells 201, 221.

Figure 3:
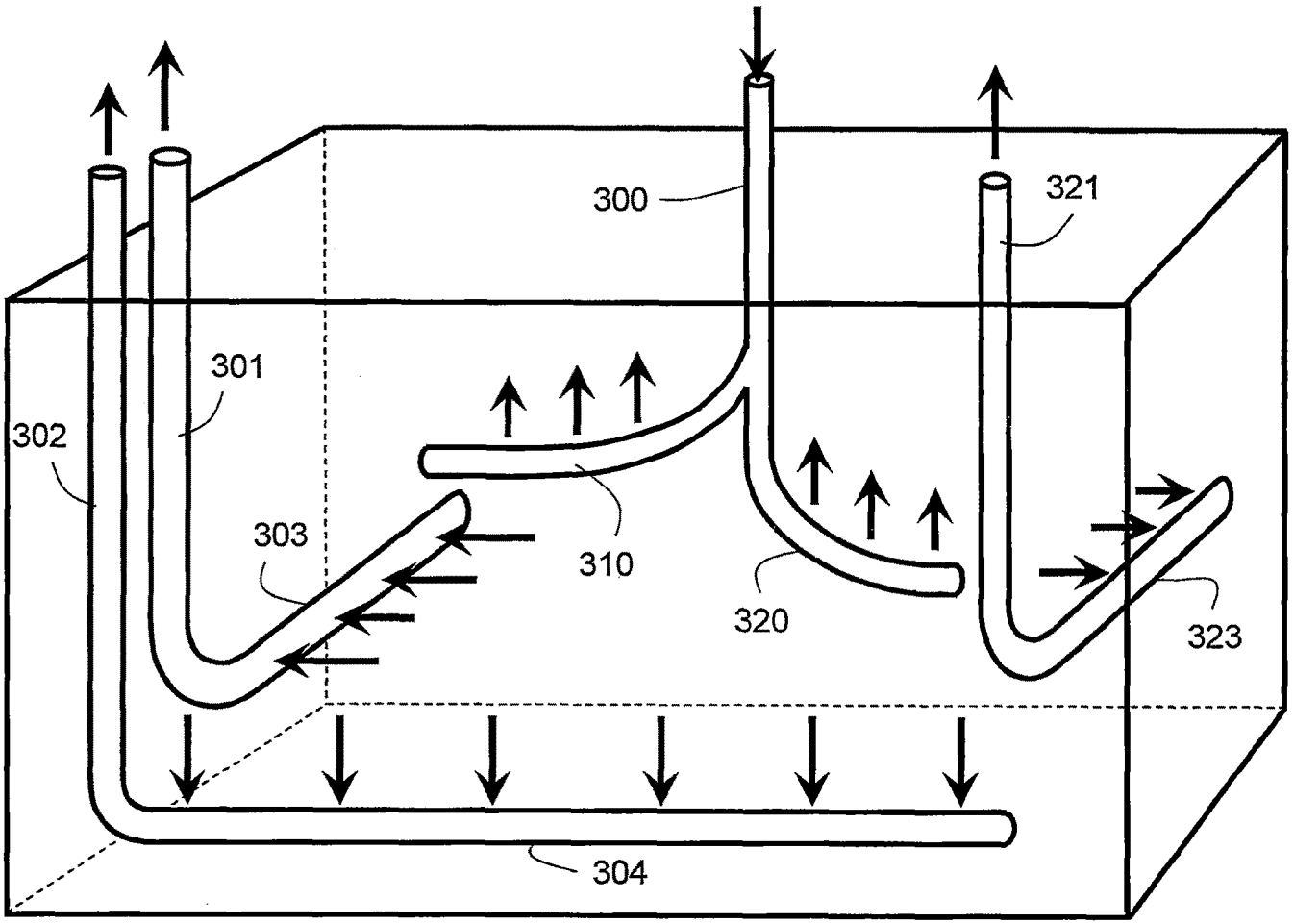
FIG. 3 is a three dimensional schematic of a multilateral injection well and misaligned staged production wells in a formation, according to one embodiment of the invention.

FIG. 3 illustrates an embodiment with a multilateral injection well 300 and first, second and third production wells 301, 321, 302 in a formation. The injection well 300 that is located between the first and second production wells 301, 321 includes lateral injector first and second boreholes 310, 320. The lateral injector first borehole 310 extends in length toward the first production well 301 high in the formation relative to the lateral injector second borehole 320 extending in length toward the second production well 321. The first and second production wells 301, 321 include respective first and second intake sections 303, 323 extending lengthwise in a "z" direction, where vertical from a surface of earth is represented in a "y" direction with "x" and "z" directions being orthogonal to each other and the y-direction. The third production well 302 includes a third intake section 304 disposed lower in the formation relative to the second and third intake sections 303, 323 of the first and second production wells 301, 321. The third intake section 304 extends lengthwise in the x-direction between the second and third intake sections 303, 323 of the first and second production wells 301, 321.

As described herein, the first and second production wells 301, 321 enable production of hydrocarbons during the in situ combustion and benefit recovery utilizing the third production well 302 as a result of the combustion gasses being produced with the first and second production wells 301, 321 during the in situ combustion. While possible to have alignment and pairing between upper and lower production wells as shown in FIGS. 1 and 2, embodiments may utilize any number or alignment among production wells as exemplified by one of such various configurations with the third production well 302 in relation to the first and second production wells 301, 321. FIGS. 1 and 2 further show an injection well for every upper and lower production well pair even though embodiments may use any injection to production well ratio and orientation of injection wells as demonstrated by one such exemplary configuration with the multilateral injection well 100.

Figure 4:
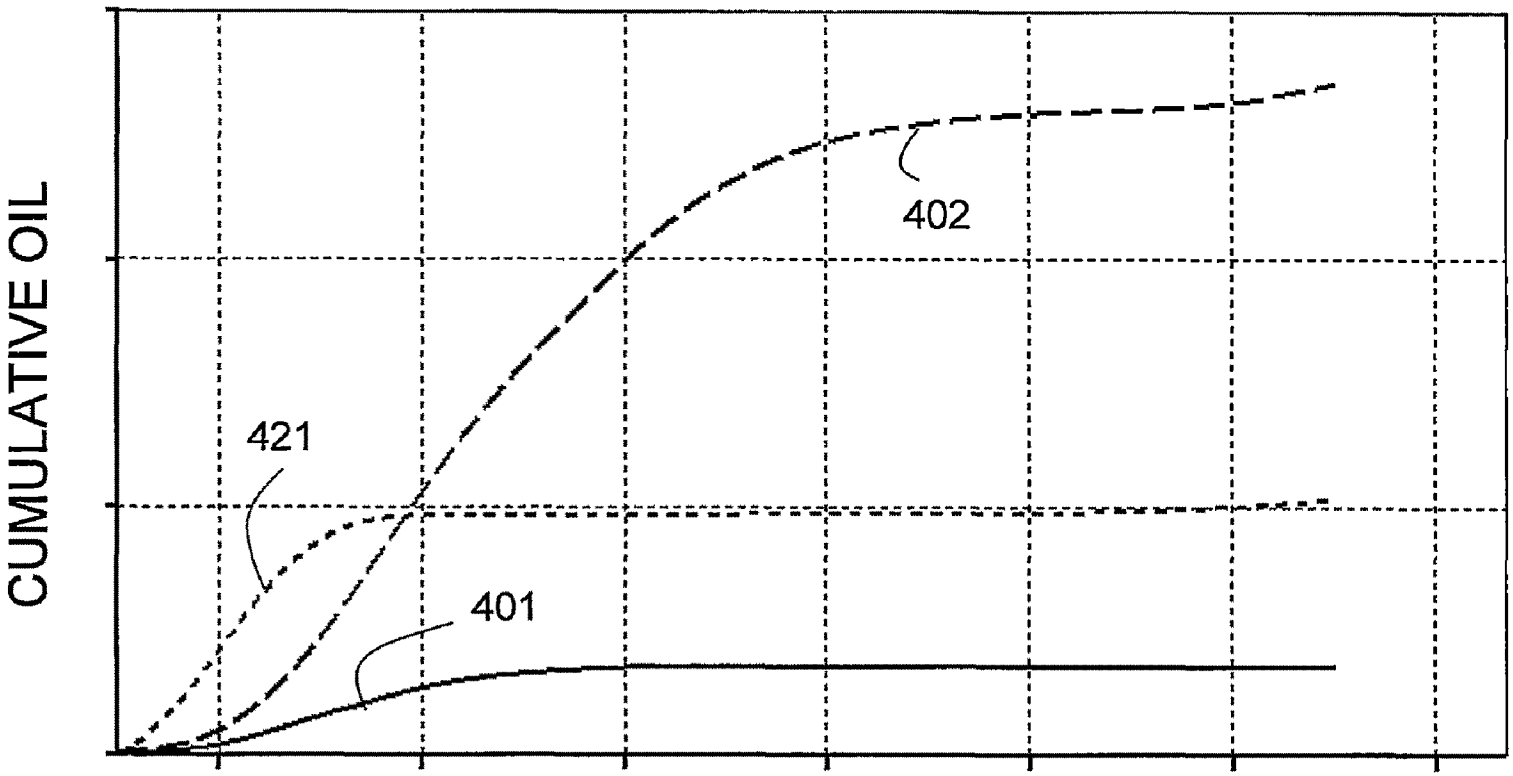
FIG. 4 is a plot of time versus modeled cumulative oil recovery for each of the production wells shown in FIG. 3, illustrating one embodiment of the invention.

FIG. 4 shows simulated results over time for cumulative oil recovery for each of the production wells 301, 321, 302 shown in FIG. 3. Plotted first, second, and third curves 401, 421, 402 correspond with the recovery from the first, second and third production wells 301, 321, 302, respectively. During an initial time period, the first and second production wells 301, 321 contributed to the cumulative oil recovery prior to the first and second curves 401, 421 flattening out as the first and second production wells 301, 321 continued to produce the combustion gasses. The third curve 402 continues upward after the first and second curves 401, 421 flatten out, which indicates that the third production well 302 provided recovery of the oil while the first and second production wells 401, 421 produced more of the gasses and less of the oil relative to the third production well 302.

Any configuration for in situ combustion such as shown herein may operate as a wet combustion process. Since air lacks ability to conduct heat as well as water molecules, water that passes through burned zones of the formation can displace heat from the burned zone better than air. Furthermore, vaporization of the water into steam transfers the heat to the steam that then migrates into thermal contact with the hydrocarbons. For some embodiments, the vaporization of the water provides ability to cool down the combustion front and thereby stabilize temperature of the combustion. As a result, adding water or steam with the oxidant can take advantage of heat that may otherwise be lost without being transferred to heat the hydrocarbons.

Start-up represents a potential problem for the in situ combustion since inefficient ignition processes due to lack of adequate initial communication between the injection well (e.g., 100 in FIG. 1) and the production wells (e.g., 103 and/or 104 in FIG. 1) can promote endothermic reactions instead of exothermic reactions. When cold, bitumen in the formation tends to block the communication between the injection well and the production well. Heating the formation around the injection well and/or the production well reduces viscosity of the bitumen and makes the bitumen mobile. In some embodiments, heating around any of the wells occurs prior to starting the in situ combustion. Such heating may utilize steam circulation and/or injection and/or resistive heating elements disposed along the wells.

For some embodiments, the in situ combustion described herein may take place after processes for cyclic steam stimulation (CSS) or steam assisted gravity drainage (SAGD). For example, injecting steam into the injection well 100 and/or the first production well 103 shown in FIG. 1 may heat and drive oil into the second production well 102 where the oil is recovered. Once recovery of the oil using this steam injection diminishes beyond economical returns, the in situ combustion commences as a follow-up recovery operation.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising the steps of:

forming an injection well into a formation;

forming first and second production wells, wherein respective first and second sections of the first and second production wells extend in length deviated from vertical and at least part of the first production well overlaps above at least part of the second production well;

injecting oxidant into the injection well to propagate combustion;

recovering liquid hydrocarbons through the first production well during the combustion; and recovering through the first production well gasses from the combustion once liquids segregate by gravity to provide an interface between the liquids and the gasses below the first section of the first production well such that the gasses are produced through the first production well while liquid hydrocarbons are recovered through the second production well with the second section disposed lower in the formation relative to the first section of the first production well.

2. The method according to claim 1, wherein the second section of the second production well is disposed at least five meters lower in the formation than the first section of the first production well.

3. The method according to claim 1, further comprising injecting at least one of water and steam with the oxidant.

4. The method according to claim 1, wherein the first and second production wells are parallel to one another.

5. The method according to claim 1, wherein the first and second sections of the first and second production wells extend in length deviated from vertical by at least 20° .

6. The method according to claim 1, wherein the second section of the second production well is disposed at least ten meters lower in the formation than the first section of the first production well.

7. The method according to claim 1, further comprising injecting steam into the formation prior to injecting the oxidant.

8. The method according to claim 1, further comprising injecting steam into the formation and recovering, through at least one of the production wells and prior to injecting the oxidant, hydrocarbons heated by the steam.

9. A method comprising the steps of:

injecting oxidant into an injection well to propagate combustion through a formation;

recovering liquid hydrocarbons through a first production well during the combustion while gravity segregation creates an interface between liquids and gasses in the formation that is above where the first production well intakes fluids; and recovering liquid hydrocarbons through a second production well during the combustion while the gravity segregation creates the interface between the liquids and gasses in the formation that is below where the first production well intakes fluids and above where the second production well intakes fluids, wherein the first production well is aligned above and overlaps the second production well.

10. The method according to claim 9, wherein a majority of the hydrocarbons recovered with the first production well occurs during an initial time period after which the first production well continues to produce gasses while recovering the hydrocarbons through the second production well.

11. The method according to claim 9, further comprising producing combustion gasses with the first production well while recovering the hydrocarbons through the second production well once the gravity segregation creates the interface between the liquids and gasses in the formation that is below where the first production well intakes fluids.

12. The method according to claim 9, further comprising injecting at least one of water and steam with the oxidant.

13. A method comprising the steps of:

injecting oxidant into an injection well to propagate combustion through a formation;

recovering, during the combustion, hydrocarbons from the formation gathered in a first section of a first production well in fluid communication with the injection well, wherein the first section extends in length deviated from vertical;

producing with the first production well gasses generated by the combustion and that enter the first section of the first production well; and recovering, during the combustion and the producing of the gasses, hydrocarbons from the formation gathered in a second section of a second production well in fluid communication with the injection well, wherein the second section extends in length deviated from vertical and is located overlapping the first section of the first production well lower in the formation relative to the first section of the first production well.

14. The method according to claim 13, wherein over a time period of the combustion the first production well produces less of liquids and more of the gasses than are being recovered by the second production well.

15. The method according to claim 13, further comprising injecting at least one of water and steam with the oxidant.

16. The method according to claim 13, wherein the oxidant is injected at locations in the formation spaced apart in both horizontal and vertical directions from one another.

17. The method according to claim 13, wherein the injection well includes multilateral branches such that the oxidant is injected at locations in the formation spaced apart in both horizontal and vertical directions from one another.

* * * * *